US006929249B1

(12) United States Patent
Kim

(10) Patent No.: US 6,929,249 B1
(45) Date of Patent: Aug. 16, 2005

(54) PNEUMATIC LIFT DEVICE

(76) Inventor: Sun Y. Kim, 2384 Lancaster Ct., Hayward, CA (US) 94542

( * ) Notice: Subject to any disclaimer, the term of this patent is extended or adjusted under 35 U.S.C. 154(b) by 0 days.

(21) Appl. No.: 10/658,927

(22) Filed: Sep. 9, 2003

(51) Int. Cl.[7] ..... B66F 3/35
(52) U.S. Cl. ..... 254/93 HP; 254/2 B; 254/93 H; 254/93 R
(58) Field of Search ..... 254/93 HP, 93 L, 254/93 H, 2 B, 93 R; 92/34–42, 89–92

(56) References Cited

U.S. PATENT DOCUMENTS 3,843,092 A * 10/1974 Oehler ..... 254/93 HP
6,092,788 A * 7/2000 Simon ..... 254/93 HP
6,199,827 B1 * 3/2001 Rimington et al. ..... 254/93 HP
6,286,812 B1 * 9/2001 Cherry ..... 254/9 C
6,513,418 B1 * 2/2003 Simmons et al. ..... 92/92

* cited by examiner

*Primary Examiner*—Lee D. Wilson
(74) *Attorney, Agent, or Firm*—Richard Esty Peterson Patent Attorney

(57) ABSTRACT

A pneumatic lift device that has a lift unit and an activatable air supply connected to the lift unit with the lift unit having a substantially rectangular base with four sides and a substantially rectangular lift platform connected to the base by a hinge mechanism that includes four foldable side panels connected to the four sides of the base and lift platform with the lift unit having an expandable bladder between the base and lift platform, wherein on expanding the bladder with pressurized air from the air supply, the lift platform rises from the base.

16 Claims, 4 Drawing Sheets

PNEUMATIC LIFT DEVICE

BACKGROUND OF THE INVENTION

This invention relates to a pneumatic lift device that has a simple and inexpensive construction, and, has a variety of common uses. In one preferred embodiment of this invention, the pneumatic lift device is sized and configured for use as an automobile trunk accessory. In another embodiment, the pneumatic lift device is configured as a stand-alone transport dolly. It is to be understood that the preferred embodiments in this specification are set forth for the purpose of aiding in the description and understanding of this invention. The embodiments are not intended to limit the scope of this invention or the variety of different applications to which the invented pneumatic lift device can be applied.

Air lift devices have been constructed in the past for a variety of different uses. Typically, an air lift is of a scissor-type pneumatic jack that is powered by an internal bellows inserted between a lift plate and a base plate. Piston-type air jacks have been used as automobile lifts and industrial elevator devices.

It is an object of this invention to avoid the scissors-type mechanism or the use of an air piston for raising and lowering a support platform. In the pneumatic lift device of this invention, a simple hinge mechanism is utilized to provide both a means of limiting the elevation of the support platform and a means of stabilizing the lift platform. In addition, an expandable air bladder is used that conforms to the underside surface of the lift platform. In this manner a substantial lifting force is developed with a minimum air supply pressure. In the embodiments disclosed in the specifications, the lift platform is substantially rectangular and when used as an automobile trunk accessory the lift device may be sized according to the compartment area of the trunk. When the pneumatic lift device is simply used as a common household lifting and transport device, the lift platform is preferably square and includes a square base with a carriage having four pivoting wheels.

Inflation of the internal bladder of the pneumatic lift device may be accomplished by a low pressure electric pump or by a simple foot-operated bellows pump. The low pressure electric pump may be conveniently powered by a cord that connects to the cigarette lighter of an automobile when the lift device is used as a trunk accessory, or by a rechargeable battery pack when the lift device is used in an environment without a convenient power source. Where the pneumatic lift device is a factory installed unit in the trunk of an automobile, the low pressure electric pump may be directly wired to the vehicle's wiring system.

It is to be understood that a primary object of the invented pneumatic lift device is to assist a person in lifting heavy objects into and out of an automobile or other vehicle. Additionally, it is an object of this invention to provide a household device to transport and lift objects to a moderate height. It is a further an object of this invention to construct the pneumatic lift device in such a manner that it is modular and may allow one or more lift units to be stacked to increase the elevation of the lifting the pneumatic lift device. These and other features of the invention will become apparent on a consideration of the detailed description.

SUMMARY OF THE INVENTION

The pneumatic lift device of this invention in its basic modular form includes a substantially rectangular base and a similar substantially rectangular lift platform. The lift platform is interconnected to the base by four hinged side panels which contain an air bladder between the lift platform and the base. The hinged side panels are each formed of an upper and lower panel section that are hinged together to inwardly articulate when the pneumatic lift device is collapsed. The four side panels are hingedly connected to the outer edges of the lift platform and base along at least the center portion of each edge. In this manner, as the lift platform is raised on expansion of the inner air bladder, the lift platform is continuously maintained parallel with the base.

In the typical configuration, the lift platform and base are square. Since the side panels inwardly fold without interference, the combined height of the upper and lower panel sections equals two thirds to three quarters of the edge dimension of the lift platform and base. Preferably, two opposed hinged side panels are hingedly connected to the lift platform and base platform along their entire edge with the remaining two opposed hinged side panels located at a center segment of the opposed edges of the lift platform and base. In order to allow the side panels to automatically fold when the air is relieved from the central air bladder, the hinged panel sections are limited in their articulation when the air bladder is inflated and the lift platform rises.

The air bladder is contained between the lift platform and based by the four side panels. Inflation of the air bladder is accomplished by any conventional electric or mechanical air pump. Typically for consumer use, the contained air bladder is inflated at no more than 1 or 2 p.s.i. When spread over the area of the lift platform the pneumatic lift device can lift an object hundreds of pounds in weight. It is to be understood that the preferred designs are inexpensive, light in weight, and preferably mass produced in plastic. In this manner the cost of a pneumatic lift unit is exceptionally low and a household pneumatic lift device may include two lift units stacked together to enable heavy objects to be raised to tables, counters and the like. It is to be understood that the dimensions and configuration of the lift platform and the base can be tailored for special uses such as the trunk of an automobile where the pneumatic lift device in one embodiment is permanently installed as an automobile accessory. Furthermore, the pneumatic lift device may include a carriage with wheels for functioning as a transport dolly as well as a lift device.

Although, the preferred embodiments described in the specifications are designed for consumer use, it is to be understood that by modification of the materials and construction, the pneumatic lift device may be utilized for commercial and other heavy duty applications.

DETAILED DESCRIPTION OF THE PREFERRED EMBODIMENTS

Figure 1:
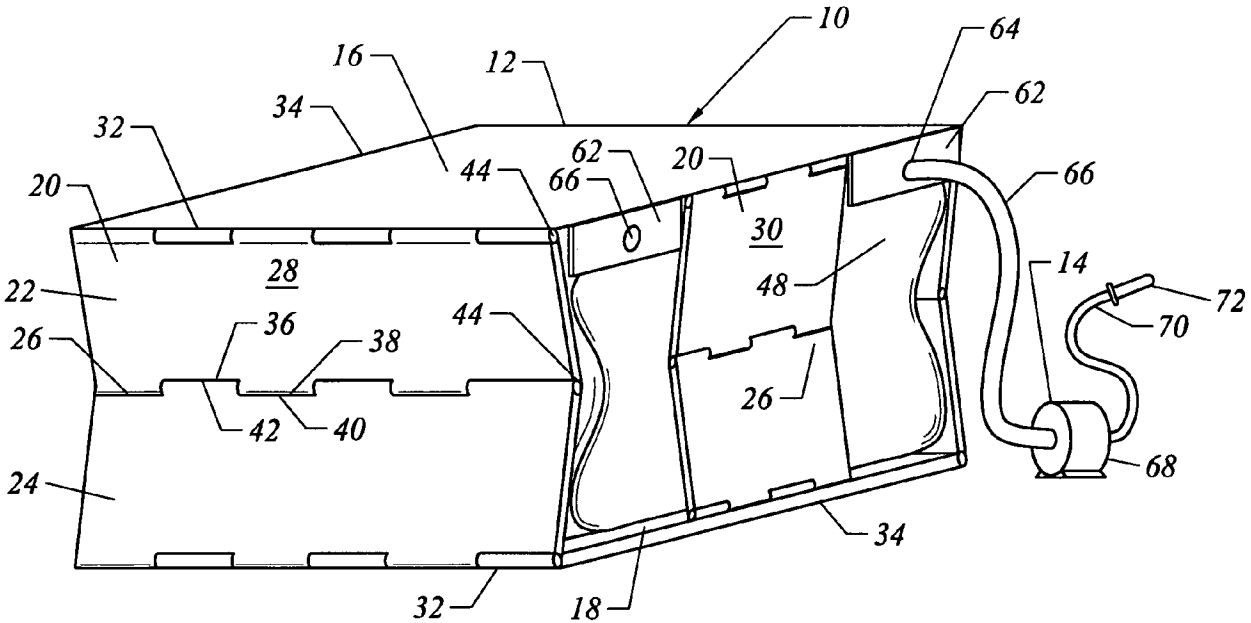
FIG. 1 is a perspective view of the pneumatic lift device of this invention with a lift unit in a substantially raised position.

Referring to FIG. 1, the pneumatic lift device of this invention is designated generally by the reference numeral 10. The pneumatic lift device 10 comprises a lift unit 12 and a pressurized air source 14. In the embodiment of FIG. 1 the lift unit 12 is fabricated of an inexpensive molded plastic with an integral hinge mechanism 15. The lift unit 12 includes a lift platform 16 that is substantially square in configuration and a substantially square base 18. The hinge mechanism 15 interconnects the lift platform 16 and base 18 and includes four foldable side panels 20. The foldable side panels 20 have an upper panel portion 22 and a lower panel portion 24 that are interconnected by a central hinge 26.

In the embodiment of FIG. 1, two opposed side panels 20 are configured as elongated side panels 28 and the remaining two side panels 20 are configured as narrow side panels 30. The upper and lower panel sections, 22 and 24 of side panels 28 and 30 are connected to the lift platform 16 and the base 18 by hinges 32 along the outer edges 34 of the square lift platform 16 and base 18.

The hinges 26 and 32 are fabricated in a manner similar to the integrally molded hinges of a conventional plastic storage container with alternate projecting tabs 36 and recesses 38 along each edge of a connected member that engage a complimentary tab 40 and recess 42 on the adjacent member. Each of the aligned tabs 36 and 38, which are used as exemplars, has a bore 43 through which an elongated rod 44 is inserted. The rod 44 functions as a pivot pin.

Figure 2:
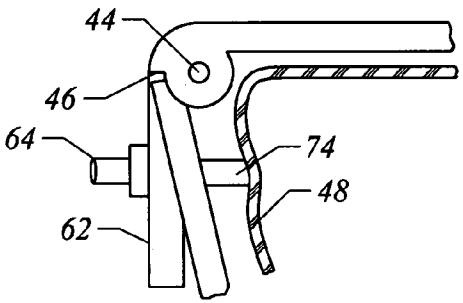
FIG. 2 is an enlarged partial view of the top side of the lift unit in the lift device of FIG. 1.
Figure 3:
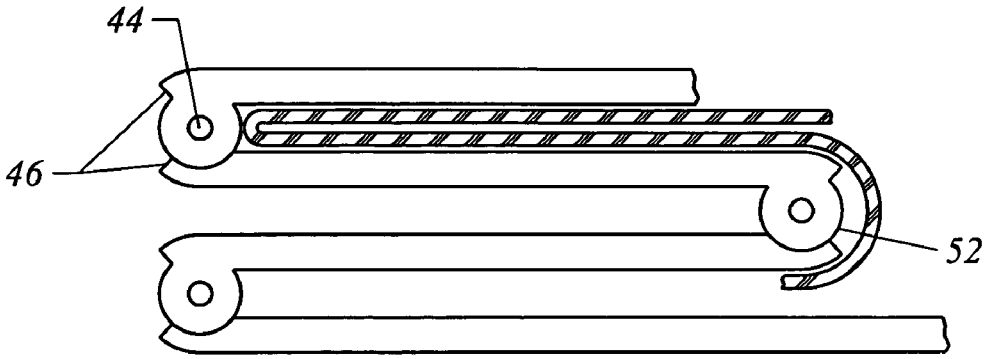
FIG. 3 is an enlarged partial side elevational view of the lift unit of FIG. 1 in a collapsed position.

Referring to FIGS. 2 and 3, the tabs 36 and 40 and recesses 38 and 42 are constructed to include nocks 46 to limit the articulation of the hinged side panels 20 with respect to the lift platform 16 and base 18. As shown in FIG. 1 and exaggerated slightly in FIG. 2 the upper panel portion 22 and lower panel portion 24 of the hinged panels 20 are able to fold inwardly to a collapse position as shown in FIG. 3 but had there outward articulation limited by engagement of the nocks 46 before the panel sections 22 and 24 become vertical. The four side panels 20 contain an expandable air bladder 48 which is fully inflated in FIG. 1. When the air is relieved from the bladder 48, the pneumatic lift unit 12 automatically collapses as a result of the predisposed angle of the upper and lower panel portions 22 and 24. Alternately or additionally, the expandable air bladder 48 may include a series of elastic tethers 50 which connect to the central hinge 26 of each of the side panels 20. In this manner, as the expandable air bladder 48 collapses the hinge panels 20 are pulled inwardly and the upper panel portion 22 folds onto the lower panel portion 24, as shown in FIG. 3.

Figure 4:
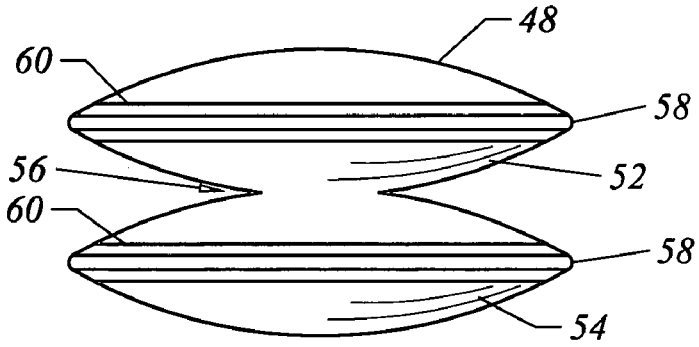
FIG. 4 is a side elevational view of an expandable bladder used in the lift unit of FIG. 1 in a partially expanded condition.

Referring to elevational view of FIG. 4, the expandable bladder 48 is shown partially expanded to illustrate the preferred configuration of the bladder 48 with an upper pillow chamber 52 and a lower pillow chamber 54 with a narrow waste section 56. When collapsed, the upper chamber 52 and lower chamber 54 sit conveniently into a narrow space between the upper panel portion 22 and lower panel portion 24 of the side panels 20. Around the perimeter 58 of the pillow chambers 52 and 54 are a series of embedded cords 60 that limit expansion of this segment of the elastic bladder 48 so that the expanded bladder remains contained within the lift platform 16, base 18 and side panels 20.

Figure 5:
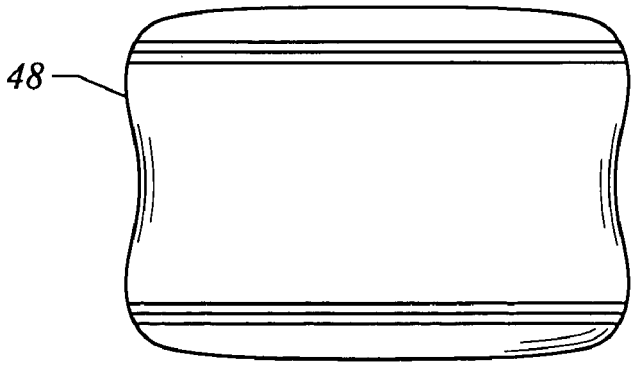
FIG. 5 is a side elevational view of the expandable bladder of FIG. 4 shown in a fully expanded condition.

Referring to FIG. 1, the lift platform 16 includes a pair of downwardly folded lip segments 62 which include an air supply connector 64 and a pressure relief valve 66. The air supply connector 64 is connected to a connector 65 at the end of the air hose 66 of the pressurized air source 14, which in FIG. 1 comprises an electric air pump 68 with an electric cable 70 with a cigarette lighter connector 72. It is to be understood that any other conventional low pressure electric air pump can be provided for use with the lift unit 12 of this invention. As shown in FIG. 2 the air connector 64 is mounted onto the lip 62 and includes a small flexible tube 74 to the internal bladder 48. The connector 64 to the air supply 14 includes an internal check valve when not visible to prevent air from escaping from the bladder 48 when inflated. When inflated, the construction of the bladder 48 is designed to expand to a configuration as shown in FIG. 5. It is to be understood that other elastic or non-elastic expandable bladders can be utilized as the lifting means for the air lift unit 12 of this invention.

Figure 6:
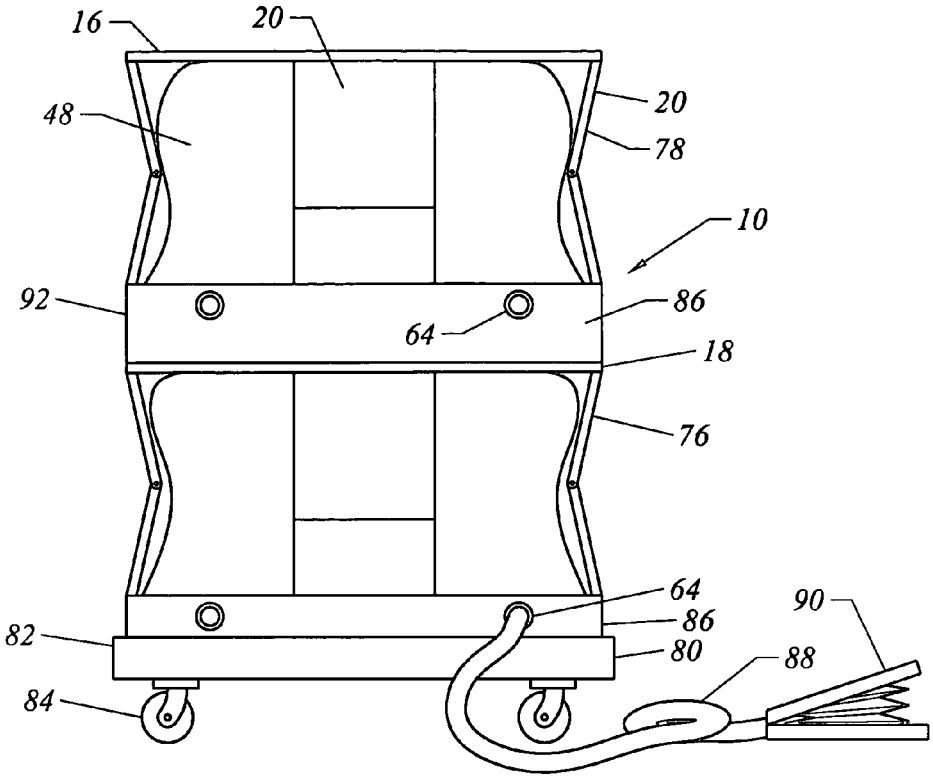
FIG. 6 is a side elevational view of an alternate embodiment of the pneumatic lift device of FIG. 1 with multiple stacked lift units.

Referring now to FIG. 6, a second embodiment of the pneumatic lift device 10 is shown. The pneumatic lift device 10 comprises a lift and transport dolly 92 which includes a pair of identical lift units 76 and 78 that are stacked on a carriage 80 that includes a perimeter frame 82 and four pivotal dolly wheels 84. The lift units 76 and 78 are constructed substantially in the same manner as the lift unit 12 of FIG. 1. However the base 18 has a perimeter rim 86 into which the side panels 20 and bladder 48 collapse with the lift platform 16 providing the cover to a compact case. The perimeter rim 86 allows for mounting of the hose connectors 64 one of which is shown connected to the connector 87 of an air hose 88 of a mechanical foot pump 90.

In FIG. 6 a lifting and transport dolly 92 can include one or more lift units to achieve the desired lifting height, conventionally the height of a standard table or counter. In this manner the transport and lift dolly can be used to move heavy objects such as televisions and computer monitors from a pick-up location on the floor to an operational location on a table or counter.

Figure 7:
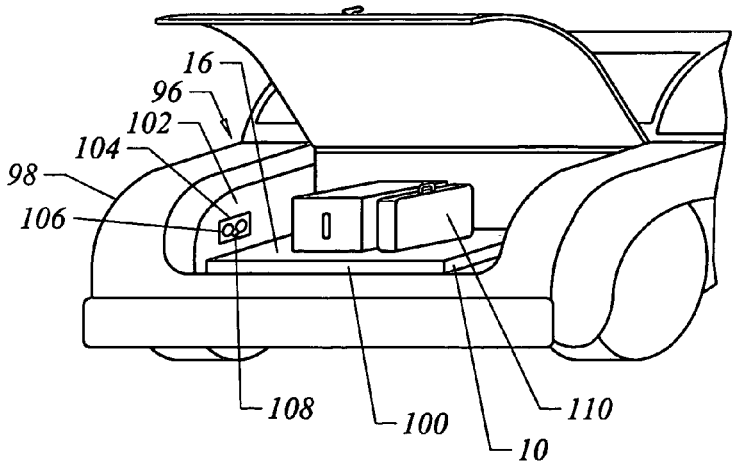
FIG. 7 is a partial perspective view of an alternate embodiment of the pneumatic lift device with a lift unit installed in the trunk of an automobile.

Referring now to FIG. 7, the pneumatic lift device 10 of this invention is schematically illustrated as a trunk accessory 96 for an automobile 98. The lift device 10 includes a lift unit 100 similar to the units previously described, and an air supply unit 102 that includes a control panel 104 that operates an electric air supply pump (not visible) that is directly wired to the electronics of the automobile 98. The control panel 104 includes an actuator switch 106 and a relief switch 108 to respectively raise and lower the lift platform 16 which is shown in FIG. 7 in its raised position for easy access to luggage 110.

Figure 8C:
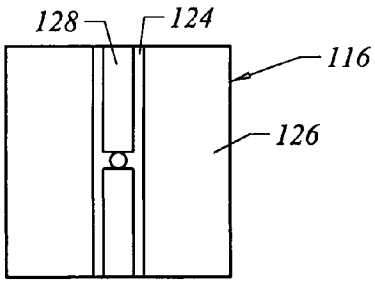
FIG. 8C is a schematic view of a third configuration of inwardly folded side panels.
Figure 8B:
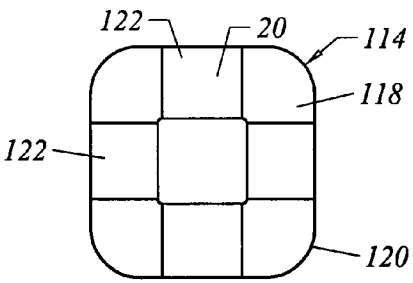
FIG. 8B is a schematic view of a second configuration of inwardly folded side panels.
Figure 8A:
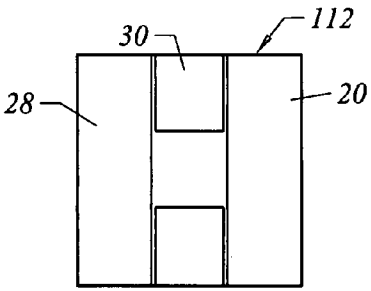
FIG. 8A is a schematic view of one configuration of inwardly folded side panels.

In FIGS. 8A, 8B and 8C, there are shown three configurations of side panels 20 for typical, substantially square lift units 112, 114 and 116, respectively. In the unit 112, the side panels 20 include the elongated panel 28 and narrow panel 30 of FIG. 1. In FIG. 8B, the lift unit 114 has a base 118 with rounded corners 120 and four narrow hinged side panels 122. In FIG. 8C, the lift unit 115 has a square base 124 with wider elongated panels 126 for added lift height and extremely narrow panels 128 to accommodate the wider elongated panels 126 when the unit is collapsed as shown.

Figure 9:
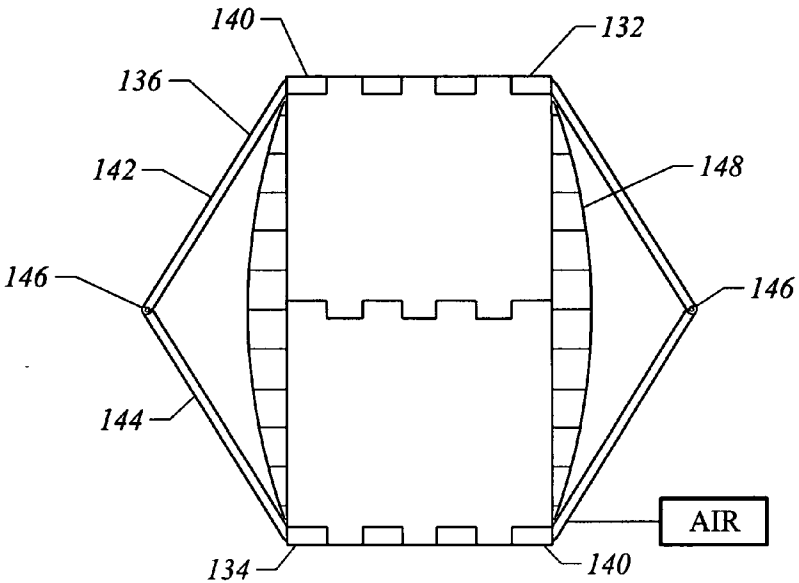
FIG. 9 is a side elevational vies of an alternate embodiment of the pneumatic lift device with outwardly folded side panels.

The side panels of the embodiments that inwardly fold must at least be connected to the center segment of the base and lift platform edges for proper operation of the hinge mechanism. Although the lift units shown in FIGS. 8A–C are substantially square, it is to be understood that the units can be rectangular, octagonal or other configuration with the recognition that the lift height is limited by the folding side panels which preferably do not overlap when the lift unit is collapsed.

Where space is not a concern, an alternate embodiment of a lift unit 130, as shown in FIG. 9, is constructed without the side panel limitations of the previous embodiments where the upper panel portion and the lower panel portion fold inwardly. The lift unit 130 of FIG. 9 does not have a limitation on the panel height to accommodate the inwardly folded panel portions of the previous embodiments, and does not require that the panels be connected to the central segment of the lift platform and base edges.

The lift unit 130 of FIG. 9 has a lift platform 132 and a base 134 with a hinge mechanism 136 with four elongated panels 138 connected to the lift platform 132 and base 134 by hinges 140. The elongated panels 138 each have an upper panel portion 142 connected to a lower panel portion 144 by a hinge 146. The hinges 140 and 146 are constructed as described with reference to the previous embodiments. However, it is understood that any conventional hinge mechanism of the general type described can be utilized. Between the lift platform 132 and the base 134 is an expandable bladder 148 that is connected to an activatable air supply apparatus 150, shown schematically, in FIG. 9.

The expandable bladder 148 is shown partially expanded with the upper panel portion 142 and the lower panel portion 144 outwardly folded. When the bladder is fully expanded the panel portions 142 and 144 are nearly vertical. When the bladder is fully collapsed, the panel portions are substantially horizontal and splayed with the lift unit 130 occupying a considerably greater area than the base. Additionally, to control the sideway expansion of the bladder 148, the bladder preferably includes embedded cord 152. Notably, the bladder can be constructed of a substantially non-stretchable material such a plastic for similar results. Some minor lateral expansion is desired to insure that the panels outwardly fold when the bladder is collapsed.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A pneumatic lift device comprising:

a lift unit including:

a substantially rectangular base having four sides;

a rectangular lift platform having four sides and being approximately the same size as the rectangular base;

a hinge mechanism interconnecting the base and the lift platform; wherein the hinge mechanism includes four foldable side panels hingedly connected to the four sides of the base and lift platform;

an expandable bladder between the base and lift platform; and, an activatable air supply apparatus connectable to the expandable bladder of the lift unit that supplies pressurized air to the expandable bladder when connected to the bladder and activated, wherein the air bladder expands and lifts the platform from the base.

2. The pneumatic lift device of claim 1 wherein the activatable air supply apparatus includes an air release for releasing air from an expanded air bladder, wherein the four foldable side panels fold as the lift platform lowers to the base.

3. The pneumatic lift device of claim 2 wherein the four sides of the base and lift platform have edges with a center segment and wherein two opposed side panels hingedly connect to opposed edges of the base and lift platform along the entire edges, and the remaining two opposed side panels hingedly connect to opposed edges of the base and lift platform at the center segment of the edges.

4. The pneumatic lift device of claim 2 wherein the foldable side panels each have a central hinge interconnecting two side panel sections.

5. The pneumatic lift device of claim 1 wherein the four foldable side panels fold inwardly as the lift platform lowers to the base.

6. The lift device of claim 5 wherein the four foldable side panels have means of initiating inward folding of the side panels as the lift platform lowers to the base.

7. The pneumatic lift device of claim 6 wherein the means for initiating the inward folding of the side panels comprises a central hinge with each panel having an upper panel section and a lower panel section interconnected by the hinge wherein the hinge has articulation limiting means for limiting the unfolding of the panel sections.

8. The pneumatic lift device of claim 6 wherein the means for initiating the inward folding of the side panels comprises means for connecting the foldable panel sections to the expandable bladder wherein the bladder is elastic and contracts when deflated drawing the foldable panels inwardly on contraction.

9. The lift device of claim 5 wherein the lift unit is configured for installation in an automobile trunk and the activatable air supply apparatus has an electric air pump with an electrical power supply adapted to be connected to an electrical system of an automobile.

10. The pneumatic lift device of claim 1 wherein the four foldable side panels fold outwardly as the lift platform lowers to the base.

11. The pneumatic lift device of claim 1 wherein four sides of the base and lift platform have a center segment and the four foldable side panels hingedly connect to at least the center segment of the four sides of the base and lift platform.

12. The pneumatic lift device of claim 1 wherein a second lift device is stacked on the lift platform of the lift device to increase the lift height.

13. The lift device of claim 1 wherein the activatable air supply apparatus has an air hose with a connector and one of the lift platform and base of the lift unit have an air connector connectable with the connector of the air hose of the air supply apparatus.

14. The lift device of claim 13 wherein the air connector of the lift unit connects to the expandable air bladder.

15. The lift device of claim 14 wherein the lift unit includes an air relief connected to the expandable air bladder to release air from an expanded air bladder.

16. The pneumatic lift device of claim 13 wherein the lift unit is combined with a carriage having a frame with dolly wheels.

* * * * *